US005116680A

United States Patent [19]

Nelson

[11] Patent Number: 5,116,680

[45] Date of Patent: May 26, 1992

[54] LIGHTLY BONDED POLYAMIDE YARNS AND PROCESS THEREFOR

[75] Inventor: Thomas L. Nelson, Georgetown, Del.

[73] Assignee: E. I. Du Pont de Nemours and Company, Wilmington, Del.

[21] Appl. No.: 661,011

[22] Filed: Feb. 26, 1991

Related U.S. Application Data

[60] Division of Ser. No. 443,371, Nov. 30, 1989, which is a continuation of Ser. No. 78,155, Jul. 27, 1987, abandoned, which is a continuation of Ser. No. 754,703, Jul. 15, 1985, abandoned.

[51] Int. Cl.[5] ..... D02G 3/00

[52] U.S. Cl. ..... 428/369; 428/97; 428/296; 428/395; 428/397; 428/398

[58] Field of Search ..... 428/369, 370

[56] References Cited

U.S. PATENT DOCUMENTS

| | | |
|---|---|---|
| 3,388,030 | 6/1968 | Estes . |
| 3,452,132 | 6/1969 | Pitzl . |
| 3,595,952 | 7/1971 | Boyer . |
| 3,611,698 | 10/1971 | Horn et al. . |
| 3,742,695 | 7/1973 | Conrad et al. . |
| 3,918,111 | 11/1975 | Dunn . |
| 3,968,638 | 7/1976 | Norton et al. . |
| 4,016,329 | 4/1977 | Matsuyama . |
| 4,056,652 | 11/1977 | Jauntt . |
| 4,222,223 | 9/1980 | Nelson . |
| 4,290,378 | 9/1981 | Wilkie . |
| 4,338,277 | 7/1982 | Saito et al. . |
| 4,343,146 | 8/1982 | Nelson . |
| 4,452,160 | 6/1984 | Tajiri . |

FOREIGN PATENT DOCUMENTS

| | | |
|---|---|---|
| 13829 | 8/1980 | European Pat. Off. . |
| 42528 | 10/1972 | Japan . |
| 1037935 | 8/1966 | United Kingdom . |
| 1150761 | 4/1969 | United Kingdom . |
| 2085040 | 4/1982 | United Kingdom . |

*Primary Examiner*—James C. Cannon

[57] ABSTRACT

A substantially twist-free multifilament polyamide yarn particularly suited for use in cut pile carpet and the process for making the yarn including impinging the yarn with saturated steam is disclosed. The filaments of the yarn are lightly bonded and the skin of the filaments is deoriented.

8 Claims, 5 Drawing Sheets

LIGHTLY BONDED POLYAMIDE YARNS AND PROCESS THEREFOR

CROSS-REFERENCE TO RELATED APPLICATIONS

This is a division of application Ser. No. 07/443,371, filed Nov. 30, 1989 is now pending which was, in turn, a continuation of Ser. No. 07/078,155, filed Jul. 27, 1987, now abandoned. Ser. No. 07/078,155 was, in turn, a continuation of U.S. Ser. No. 754,703, filed Jul. 15, 1985, now abandoned.

TECHNICAL FIELD

This invention relates generally to improved polyamide multi-filamentary yarns, more particularly it relates to a polyamide yarn for use in cut pile carpets without requiring ply-twisting and the process for making such yarns.

BACKGROUND

Two or more bulked continuous filament nylon yarns to be used as pile in cut pile saxony carpets are usually ply-twisted together then heat set while traveling on a moving belt in a relaxed condition through an enclosure in which saturated steam under pressure permeates the yarn. This treatment sets the yarns in the twisted configuration so that they retain a substantial degree of twist after tufting, cutting, dyeing and wear and give an appearance of compact, columnar tuft shafts. The appearance of compact, columnar tuft shafts with well-defined tuft tips is desired for cut pile saxony carpets, as opposed to cut pile velour carpets where the appearance of tuft integrity is not desired.

Yarns which are not sufficiently twisted or heat-set lose their twist so that filaments of one tuft intermingle with those of another, giving a matted appearance.

However, ply-twisting and heat setting are both slow and expensive operations. A yarn meeting the same performance standards as ply-twisted heat-set yarn without requiring twisting could be highly desirable.

SUMMARY OF THE INVENTION

A multifilament polyamide yarn product that does not require ply-twisting and is particularly suited for use as pile in cut pile fabric, including both carpets and upholstery because it does not spread out and mat, has now been discovered. The yarn comprises filaments in the range of about 5–40 denier per filament having an oriented core portion and a disoriented skin portion characterized by a Skin Deorientation Index of about 0.1 or greater and preferably less than about 0.5 and a thickness of the deoriented skin portion of about 0.4–3.0 micrometers. The filaments may be crimped by any of the known methods but crimps are preferably random in frequency, direction and amplitude. The multifilament yarn is characterized by a bending rigidity ratio ($R/R_{cfm}$) in the range of about 20–200 in the absence of adhesive or size, preferably in the range of about 20–75, a lateral pull apart distance of about 4 cm., and the number of filaments are less than about 500, with a portion of these being lightly bonded together. Yarn having a bending rigidity ratio of 20–75 is generally suitable for residential carpets while yarn at 75–200 can be used for heavy wear installations.

The yarn bundle may be substantially free of true yarn twist. This does not exclude a small amount of twist which may occur incidentally in the handling of the yarn bundle, such as by overend take off of the yarn bundle in a conventional manner from a stationary package, as from a creel. A yarn bundle having no more than about one turn of true twist per 3 cm is considered to be substantially twist free.

The improved properties are believed to arise in part from a deorientation of the polymer molecules in the outer region or skin portion of the filaments and in part from light bonding among the filaments. Evidence for deorientation can be obtained from observation of the birefringence difference between skin and core or by observing the general lack of anisotropy present in a mechanically delaminated section of "skin". Evidence of light bonding among the filaments can be observed by physically pulling the yarn apart by hand and also can be seen by following the procedures set out in Example 5. Yarns of this invention are found to be significantly stiffer than yarns that have not been subjected to the process of this invention as determined by a ratio of the bending rigidity of the yarn bundle measured as described herein to the computed rigidity of the same yarn bundle wherein the filaments are completely free to move relative to each other. Yarns of the invention derive such stiffness from the heat and moisture treatment accompanied by the compacting effects of the close-fitting inlet and outlet passages of the steam treating chamber without the presence of adhesive or size. The inlet passage has a diameter roughly the same size or smaller than the diameter of the yarn bundle resulting in the crimped surface filaments of the yarn bundle being slightly compressed in the inlet passage. It is indeed surprising that yarns having stiffness characteristic of the present products can develop such a high degree of bulk during carpet finishing. The bending rigidity ratio is a measure of the degree of light bonding among the filaments. At two low a bending rigidity ratio, there is too little bonding among the filaments in the yarn bundle and the carpet made from such yarn bundle spreads out to give a matted appearance. At too high a bending rigidity ratio too many strong bonds are formed and the carpet made from the yarn bundle is harsh to the touch and the filaments are excessively fused.

The yarn bundle of this invention is radially compressed while passing through the inlet and outlet passages of the steam treatment chamber forcing the filaments into a more intimate arrangement than is characteristic of such filaments without such compression and the filaments are lightly bonded where the filaments touch. Since the filaments retain a substantial amount of their original crimp, these contact points are of a limited area and the light bonding at the contact points substantially disappear later when the yarn is flexed during tufting and carpet finishing. Nevertheless, the combination of light bonding and the more intimate arrangement gives the product of the present invention a desirable degree of stiffness and coherency which allow it to be used in cut pile carpets without the cost of the usual ply-twisting and heat-setting. The temporary nature of the light bonding and the retention of crimp recovery ability permits the present yarns to recover bulk in final carpet form.

The process of forming light bonds between filaments and compactness of the present product is particularly beneficial when unusually bulky feed yarns are used. Such yarns may have such large filament loops extending from the yarn surface that they cannot be fed satisfactorily through conventional yarn guides and needles of standard carpet tufting machines. When such yarns are processed in accordance with the present invention with adjustments of apparatus dimensions to suit the product in accordance with the disclosures herein, the surface loops are found to be compressed onto the yarn bundle sufficiently for the yarn to feed satisfactorily through tufting, yet they unfold and expand during carpet finishing to recover their desired bulk and texture.

The product is made by a process of passing one or more crimped multi-filamentary polyamide yarns under tension through a close-fitting inlet wherein the length is 5.1 cm or more, subjecting them to saturated steam substantially free of entrained water and impinged on the axis of the yarn bundle and exposing it to the steam for a time of 150 milliseconds or less, preferably about 30 to 70 milliseconds in a chamber of sufficient size to allow the filaments to spread and be treated individually by the steam which is maintained at elevated pressure equivalent to saturation at the specific temperature of the steam, and passing the filaments through a close-fitting outlet similar to the inlet preferably of the same diameter to about 0.7 of the inlet diameter, at a ratio of outlet to inlet tension of 1.1 to 1 or greater, and winding on a package.

DETAILED DESCRIPTION OF THE DRAWINGS

Figure 1:
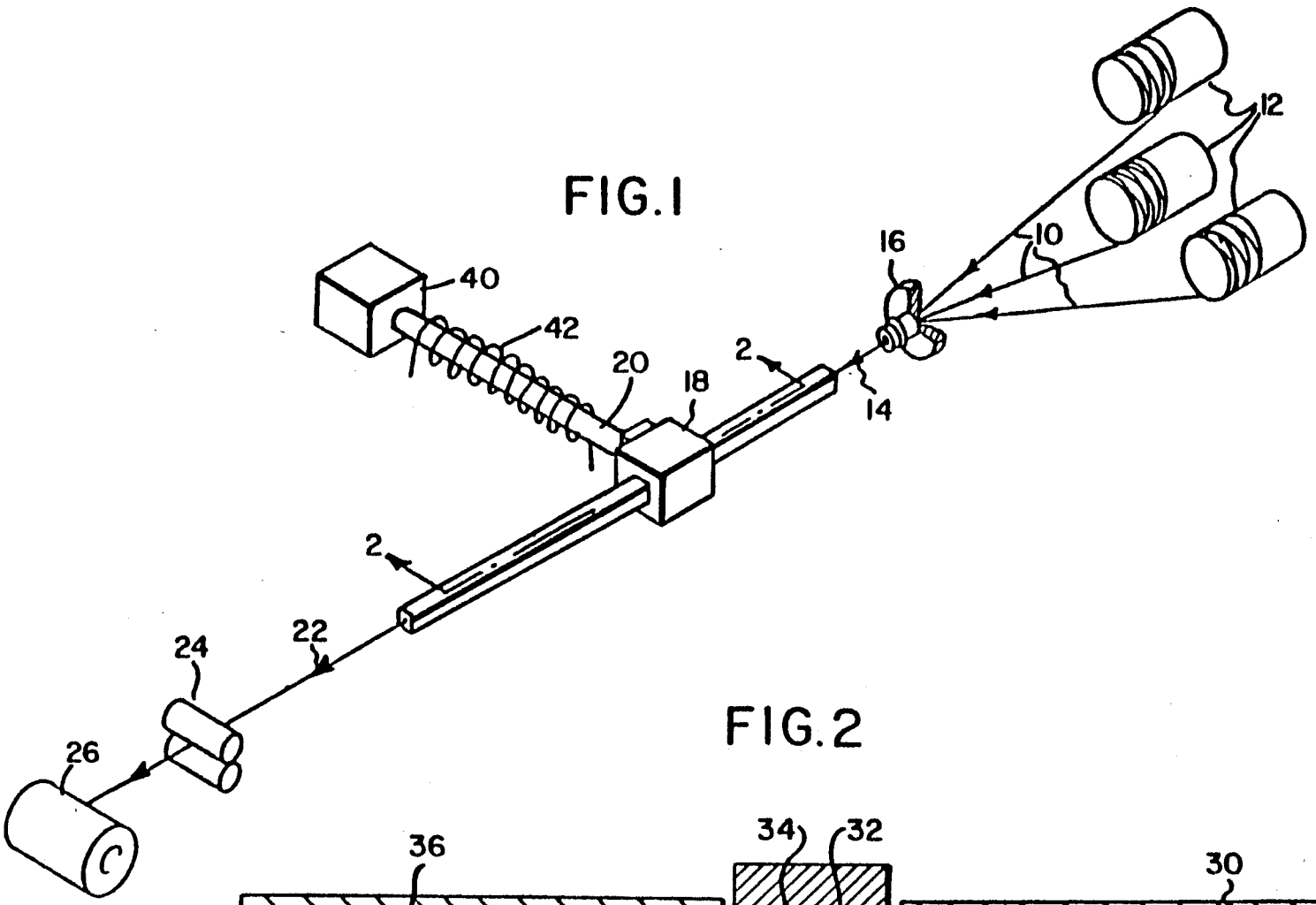
FIG. 1 is a schematic representation of an apparatus for practicing the process of the invention.

Referring to FIG. 1, one or more crimped continuous filament yarns 10 are taken from supply packages 12, combined into a yarn bundle 14 at guide 16 and led through stream treatment device 18 where the yarn is treated by impinging saturated steam at elevated pressure on the yarn bundle. Saturated steam is supplied from a source (not shown) and enters the steam treatment device 18 through pipe 20. Treated yarn 22 then passes through forwarding rolls 24 to windup package 26.

Figure 2:
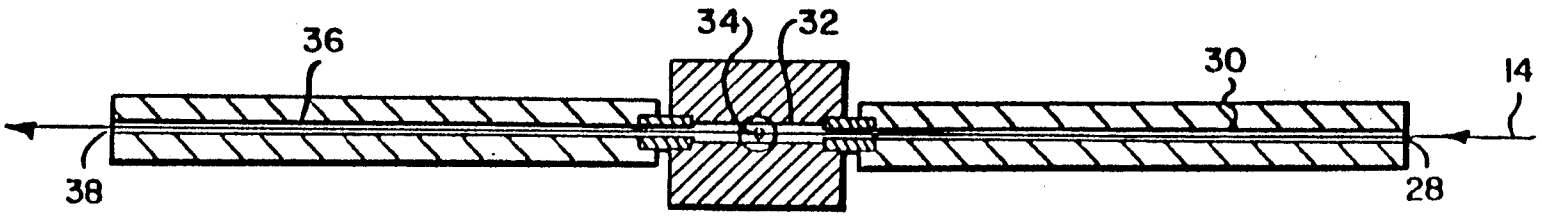
FIG. 2 is a longitudinal section taken along lines 2—2 of FIG. 1.

FIG. 2 shows a longitudinal cross-section of the steam treatment drive 18 in FIG. 1, wherein yarn bundle 14 enters inlet 28, an elongated tube having a close-fitting passage 30 through which the yarn bundle passes to chamber 32 where a portion of the saturated steam from chamber 32 travels countercurrent to the direction of yarn movement and beings to heat yarn bundle 14. As the yarn bundle enters chamber 32, saturated steam from orifice 34 impinges on the longitudinal axis of the chamber and the yarn bundle, separating the filaments, and heating them individually on all sides, after which the yarn passes out of chamber 32 through close-fitting passage 36 of outlet 38.

The passage 30 should preferably have a cylindrical bore of small enough inside diameter that no substantial amount of steam escapes from the upstream inlet 28 under the particular operating conditions selected. On the other hand, it should not be so small that friction between the yarn bundle and inlet imposes excessive tension on the yarn. The degree of crimp in the filaments, the denier and number of the filaments and other factors may influence the diameter selected. Steam condensing on the incoming filaments assists in minimizing leakage as do higher yarn speeds.

Chamber 32 in which steam impinges on the yarn should be of large enough inside diameter so that the filaments can spread apart to be treated on all sides by the steam. Surprisingly, this diameter may actually be less than that of passage 30 under some modes of operation. The tension on the filaments is higher in the chamber than in passage 30 due to the increasing drag between yarn and inlet wall as the yarn progresses, and this tension, coupled with the increasing filament temperature, straightens the filaments temporarily. Thus, they occupy considerably less space than previously and have much greater freedom to move about while being steam treated.

The diameter of chamber 32 should not be so large that the yarn bundle can avoid the direct impingement of steam from orifice 34. A maximum chamber diameter of about 1.5× the diameter of passage 30 is preferred.

In chamber 32, the filament surfaces reach their maximum temperature approaching that of the steam. The water vapor lowers the melting point of polyamide yarns drastically, causing the surfaces or skin of the filaments to molecularly deorient and reach a "tack point" at which they may form light bonds. The limited penetration of the water vapor prevents deorientation of the core of the filaments, thus preserving their desired properties such as tenacity and their ability to recover crimp and bulk during carpet finishing. The deoriented skin is a minor percentage of the total filament.

The steam treated yarn then passes into passage 36, which may be of about the same inside diameter as passage 30 or smaller. In this portion of the apparatus, some leakage of steam downstream may be desirable, since a substantial steam throughput is necessary to give a high enough velocity of steam flowing through orifice 34 to separate and treat the filaments adequately. Aside from leakage, a substantial quantity of steam is carried downstream with the yarn. Therefore, the inside diameter of passage 36 may be the same size as passage 30 even though the yarn tension and temperature straightens the crimp and makes the yarn somewhat less bulky than when it passes through inlet 28. Alternatively, the inside diameter of passage 36 may be about 0.7 of the diameter of passage 30.

The sealing effect of the inlet and outlet passage depends on a combination of their diameters as compared to the diameter of the yarn and lengths. A very short passage would need to be very small to give adequate sealing, but this may impose excessive tension on the yarn. For practical purposes, lengths of 2 inches or more as measured from steam impingement orifice 34 are preferred. The outlet passage may preferably be longer than the inlet.

The ratio of yarn tension downstream of the outlet to yarn tension upstream of the inlet is a useful process control parameter. It is a measure of the frictional drag imposed on the yarn during its passage through steam treatment device 18. This ratio should be at least 1.1:1, since any lower reading indicates inadequate sealing against steam leakage. While there is no definite upper limit, each product will have preferred operating limits to avoid pulling out excessive amounts of crimp, bulk or entanglement.

Steam flashes off the yarn as it emerges from outlet 38 into atmospheric pressure. The yarn may be cooled and dried adequately by the rotation of the windup package or by extending the distance between steam treatment device 18 and windup package 26. If forced cooling is necessary, it should be performed in a manner which does not separate the filaments, such as treating with cold air under confinement similar to that in outlet 38 or by contact with a heat sink.

It is important that the saturated steam supplied through pipe 20 be substantially free of entrained water, since the presence of liquid condensate causes variations in the dye receptiveness of polyamide yarns. To this end, one or more condensate separators 40 may be installed in the supply line leading to pipe 20, and the line and pipe should be maintained at the desired temperature by known means such as wrapping electric heating cables 42 around the line or steam tracing.

When yarns of different dyeabilities or other different properties are employed, the different components may not be affected equally by the processing conditions.

For example, lower-melting filaments may become excessively deoriented and fused, creating an undesirably harsh and stiff product. Optimum processing conditions for such products may be determined by experimentation.

A preferred product of this invention is made from two or more crimped yarns 10 of at least two different colors or dyeabilities, at least one but not all of which is interlaced and then all yarns are entangled together as described in Nelson U.S. Pat. Nos. 4,222,223 and 4,343,146. When the above-preferred product of the invention is made into cut pile carpet, dyed and finished, the added cohesion given the yarn by radial compression in outlet 38 persists during wear, effectively locking the fibers into their positions relative to one another which existed at the time of processing. Therefore, filaments of a given color remain substantially together, giving definite spots of color and the appearance of tuft definition. Yarns described in Nelson U.S. Pat. No. 4,343,146 are particularly benefitted by processing in accordance with the present invention. In a yarn where too few or no light bonds are formed, the filaments of a given color separate and mingle with those of a different color giving a blurred and indistinct appearance.

TEST METHODS

LATERAL PULL-APART TEST

The Lateral Pull-Apart Test directly measures the lateral bundle cohesiveness of a yarn. Two hooks are placed at a randomly selected point in about the center of the yarn bundle to separate it into two groups of filaments. The hooks are pulled apart at a rate of 5 inches/min. (12.7 cm/min.) at a 90° angle to the yarn axis by a tensile testing machine which measures the resistance to separation, such as an "Instron" machine. The yarn is pulled apart by the hooks until a one-pound (454 gm.) force is exerted, at which point the machine is stopped and the distance between the two hooks is measured and recorded. Ten determinations are made and the average taken as the pull-apart value. The test yarn lengths should be at least 4–6 inches. (10–15 cm. ) long and selected randomly throughout a yarn package.

Normally, in yarns composed of two or more feed yarns, the component yarns are not distinguishable and so a random placement of the hooks in the yarn gives a satisfactory measurement of bundle cohesiveness. If component yarns can be distinguished, the hooks should be inserted through at least two of the components.

MEASUREMENT OF "SKIN DEORIENTATION INDEX" (SDI)

When the fibers pass through the steam chamber their outer regions partially melt and deorient producing a skin/core structure. Evidence for this deorientation can be seen by observations of the fibers in core-matching refractive index fluids selected as determined below for both refractive indices, $n_{\perp}$, $n_{\parallel}$. With the microscope set to observe $n_{\perp}$ the fringes passing through the skin are displaced in a direction corresponding to a higher refractive index relative to the core. Conversely, when $n_{\parallel}$ is examined, the fringe displacement in the skin corresponds to a lower refractive index relative to the core. The difference in refractive indices, i.e., the birefringence, of the skin is less than the birefringence of the core. Since birefringence reflect molecular deorientation, the skin is disoriented.

Other evidence for a deoriented skin can be observed with a polarizing microscope. By carefully pulling apart two bonded fibers, portions of the skin can be examined. When viewed in the 45° position, between crossed polars most of the skin appears isotropic.

Figure 3:
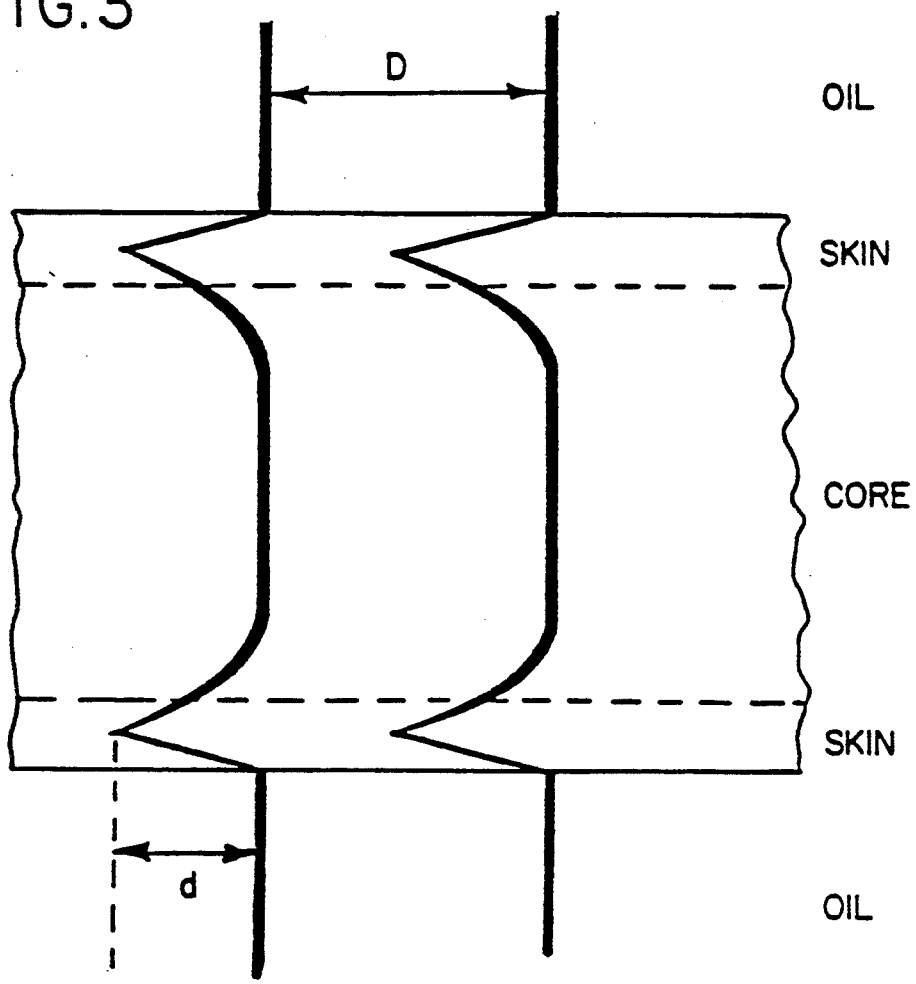
FIG. 3 is a schematic representation showing the fringe shift which characterizes skin-core orientation differences and skin thickness.

SDI is an empirical measure of the deorientation in the skin. It is a value associated with the difference in refractive indices between skin and core for light polarized parallel to the fiber axis modulated by the skin thickness. It is deduced from the observation of the fibers with a two beam Leitz transmitted light interference microscope (Ser. No. 592,469) set for the fringe field mode. Illumination is provided by a mercury arc lamp filtered to provide a wavelength of 546 nm. The fibers are observed in a core-matching refractive index fluid (nominal value 1.572 at a wavelength of 589 nm and at 25° C.), manufactured by R. P. Cargille Laboratories, Inc., at a nominal magnification of ×500. The procedure for calculating the SDI entails measuring the fringe displacement in the skin, d, relative to the interfringe spacing, D, as depicted in FIG. 3. This is determined with the aid of the drum compensator on the interferometer and an eyepiece cross-hair reticule. D is an instrumental constant and for this instrument corresponds to 210.5 divisions of the drumscale for a wavelength of 546 nm.

The sample is prepared as follows: A plain microscope slide is halved and some fibers are placed on both halves, immersed in a selected fluid. A cover slip is placed over both slides. One slide preparation is placed on the sample stage of the microscope and positioned so there is a fiber in the field of view. The other preparation is placed on the microscope's reference stage with no fibers in the field of view. This is a standard procedure to ensure that both beams of the interferometer have identical path lengths. The interferometer is adjusted so that vertical fringes appear in the field of view and one fiber is oriented perpendicularly to the fringes. The microscope's analyzer is set to transmit light vibrating parallel to the fiber axis. The interferometer is adjusted for maximum sharpness of the fringes. Preliminary observations are necessary to select the core-matching refractive index fluid. The selection of this fluid is determined by successively immersing the fibers in a series of refractive index fluids. The core matching fluid is that fluid producing the smallest fringe displacement inside the fiber. When hollow fibers are measured, regions corresponding to the hollow part of the fibers are disregarded.

Figure 4B:
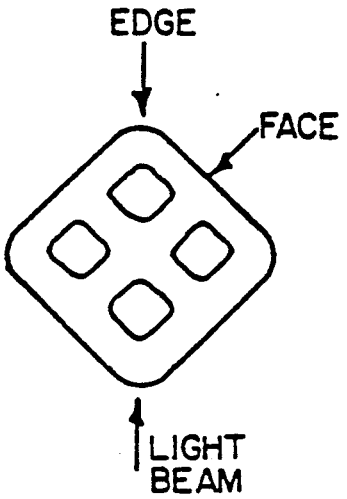
FIGS. 4*b* and 5*b* are schematic cross-section representations of the filament position from which the micrographs of FIGS. 4*a* and 5*a* were taken.
Figure 5B:
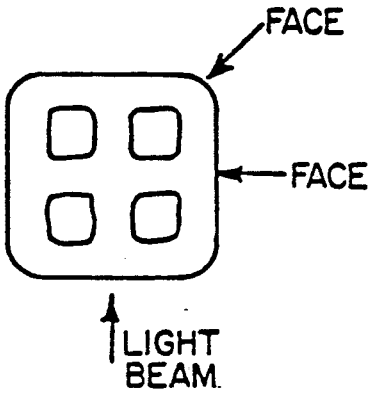
Figure 4A:
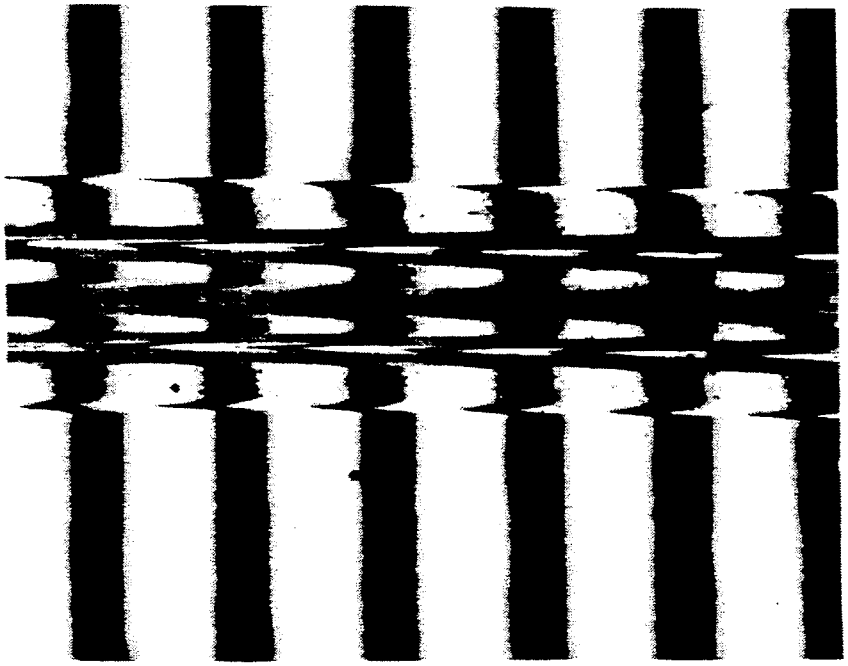
FIGS. 4*a* and 5*a* are interference micrographs of a cross-section of a filament showing the fringe shift which characterizes skin-core orientation differences and skin thickness.
Figure 5A:
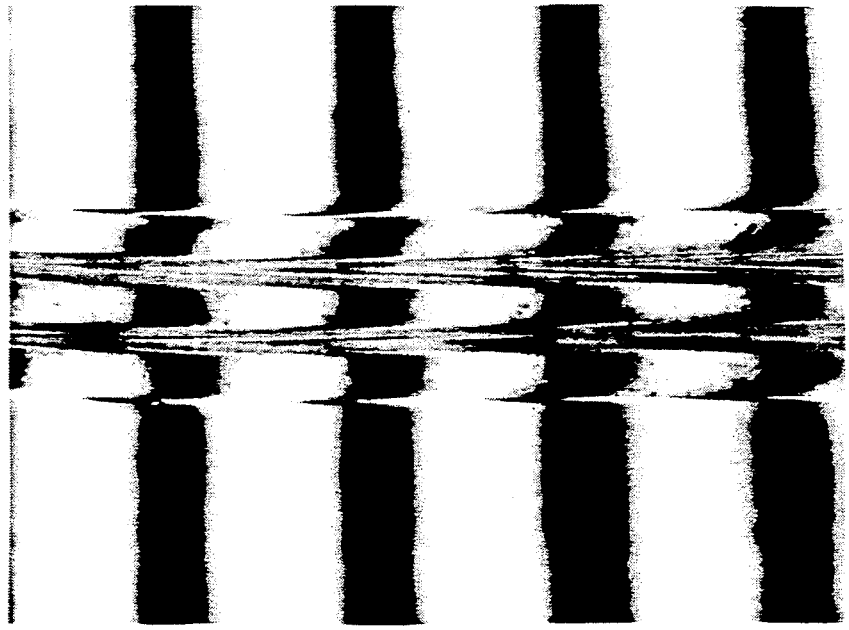
Figure 6:
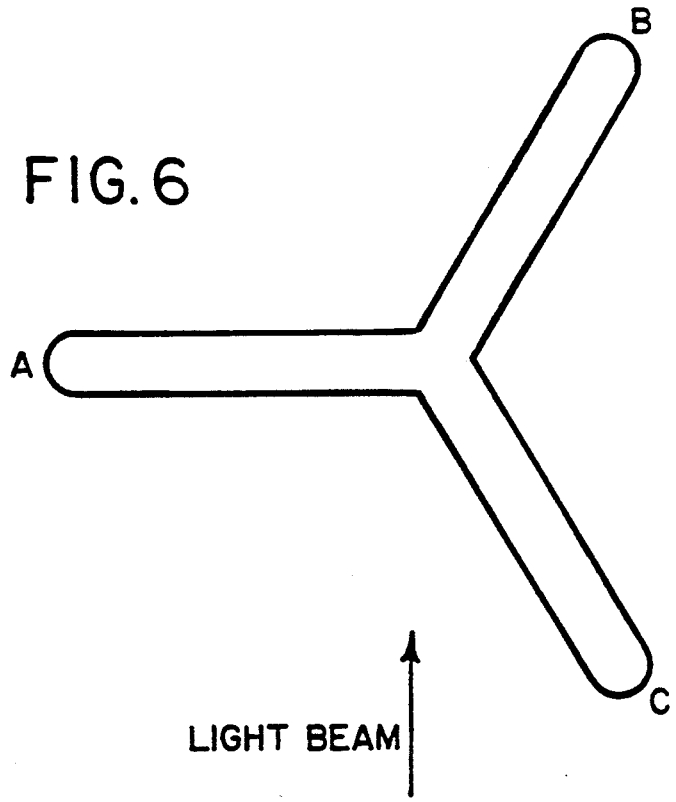
FIG. 6 is a schematic representation of a cross-section of a trilobal filament.

A region of the fiber is first selected where the fringe shift in the skin is clearly delineated. For example, in the case of a hollow, quasi-square cross-section, a proper attitude relative to the light beam is required. A proper attitude is one for which the fiber lays on one of its edges so that three voids are seen. This is illustrated in FIGS. 4*a* and 4*b*. If only two voids are observed, the fiber is laying on a face as shown in FIGS. 5*a* and 5*b*. In such a case the fringe pattern in the skin is obscured by refraction effects and d cannot be measured. For fibers having a star cross-section, e.g. trilobal, the measurement is obtained from a lobe whose skin isn't eclipsed by another lobe. For an attitude as depicted in FIG. 6, the measurement would be taken from lobe A; lobes B and C cannot be measured because their images are superimposed.

To measure d, the drum compensator is turned until the fringe pattern is positioned so that a background fringe is superimposed on the vertical line of the reticle; the corresponding compensator reading is noted. The pattern is then translated to bring that region of the fringe where the displacement is maximum (i.e., in the skin) in coincidence with the vertical line; the new compensator reading is noted. The absolute value of the difference between the two readings is d. The SDI is calculated as follows:

$$SDI = \frac{d}{D}$$

Fibers of this invention have an SDI of at least 0.05.

SKIN THICKNESS

The approximate skin thickness can be obtained by photographing the fiber in the fringe field mode at a nominal magnification of ×500. The skin thickness is measured from the micrograph with a ×4 magnifier containing a reticles scale of 50 mm incremented in units of 0.1 mm. The magnifier was calibrated from another ×500 micrograph of a micrometer slide (Carl Zeiss) ruled to 0.01 mm. The skin thickness is always less than 4 μm.

BENDING RIGIDITY RATIO

The bending rigidity ratio ($R/R_{cfm}$) is determined by measuring the bending rigidity (R) of the yarns and dividing by the computed rigidity of the same basic yarn wherein the fibers are completely free to move relative to each other, ($R_{cfm}$), the subscript measuring "Complete Freedom of Motion".

Figure 7:
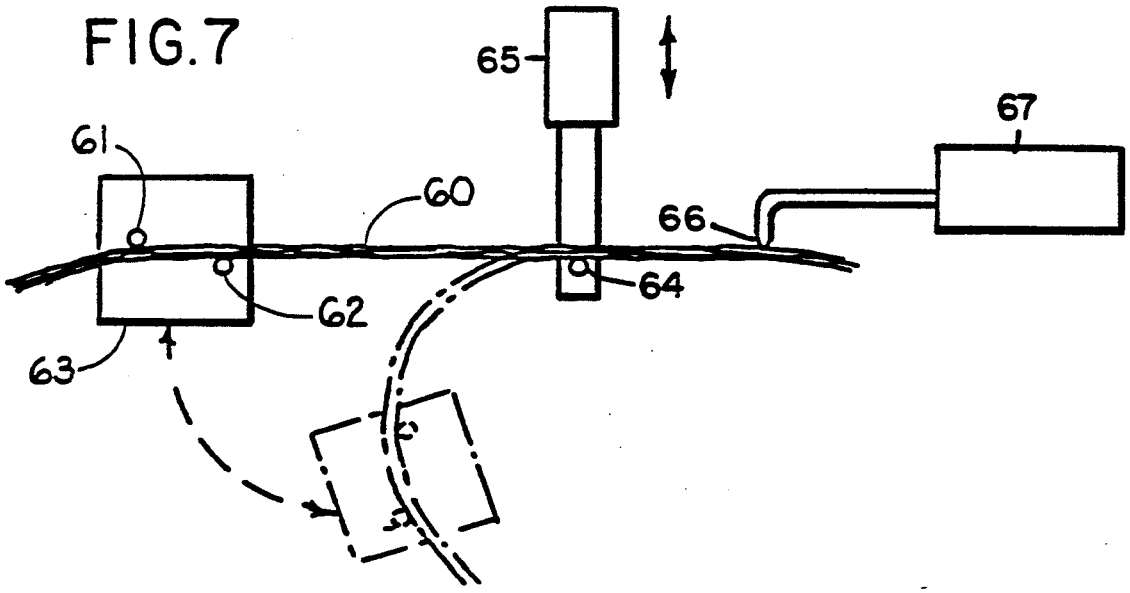
FIG. 7 is a schematic diagram of an instrument for measuring bending rigidity of yarn samples.

The yarn bending rigidity can be measured by a number of techniques such as by using a Mitex Mk II Bending Tester manufactured by IDR, Needham, Mass., U.S.A. In this test, referring to FIG. 7, the yarn sample 60, which is about 2 inches (5.1 cm) long, is inserted as shown between pins 61 and 62 mounted on block 63 and between pin 64 and arm 66. Then pin 64 mounted on micrometer 65 is adjusted to bring yarn sample 60 into light contact with arm 66 of force transducer 67. The distance from pin 62 to arm 66 is 1 inch. Block 63 moves to bend the sample into circular arcs of progressively increasing yarn curvature (curvature=1/radius of curvature). This deformation is accomplished by movement of block 63. The maximum curvature is 1.5 in.$^{-1}$. The outputs of the force transducers and a transducer which measures block rotation are fed to an X-Y recorder. Since the bending movement on the sample equals the force on the force transducer times the distance between pins 64 and 66 and the curvature is proportional to the block rotation, the output plot gives the yarn moment-curvature response.

The slope of the moment-curvature plot equals the sample rigidity and has units of force-length$^2$. The instrument is calibrated before measurements are made by measuring the slope of a stainless steel strip of calculated rigidity, 0.001 inch (0.0025 cm.) thick and 0.5 inch (1.27 cm.) wide inserted in place of the yarn. The rigidity of the stainless steel strip is calculated by the following equation:

$$R_c = w_c t_c^3 E_c / 12$$

where $R_c$=Rigidity of calibration strip
$w_c$=width of calibration strip=0.5 in.
$t_c$=thickness of calibration strip=0.001 in.
$E_c$=Young's modulus of calibration strip=30,000,000 psi.

therefore:

$$R_c = 1250 \text{ in}^2\text{lb.}$$

The slope of the calibration strip plot is divided into the calibration strip's calculated rigidity to give the calibration factor. The rigidity of any unknown yarn samples equals its slope times the calibration factor.

Five yarn samples from each item are measured as above and the results are averaged to give the values for R. The value of $R_{cfm}$ calibration is computed by multiplying the rigidity of a cylinder having the modulus of a fiber by the number of fibers.

In terms of the combined "textile" and engineering units, the relation can be written as:

$$R_{cfm} = K \frac{N_f E_f w_f^2}{d_f}.$$

where:

$K = 3.02 \times 10^{-11}$ lb. in.$^2$/(den)(cc)
$N_f$=No. of filaments in a yarn (calculated from ratio of yarn to filament denier)
$E_f$=Fiber modulus (g/denier)
$w_f$=Filament Linear Density (denier)
$d_f$=Filament Density (g/cc), R is then divided by $R_{cfm}$ to give the bending rigidity ratio for each item.

EXAMPLES

Example 1

Various crimped multifilament yarns are entangled together by several processes and are passed through a saturated steam treatment device under conditions shown in Table 1. Feed yarn A is 1225 denier 19 denier per filament cationic dyeable jet-bulked continuous filament nylon 66 yarn, each filament having a cross-section approximating a square with rounded corners and a continuous void near each corner. Yarn B is the same as yarn A except for being light acid dyeable. Yarn C is the same as yarn A except for being deep acid dyeable and with the addition of 20 denier 3 filament yarn having conductive carbon in the core for antistatic purposes as disclosed in U.S. Pat. No. 3,803,453. Yarn D is 1750 denier nylon 6.31 denier per filament bulked continuous filament yarn, each filament having a 6 void pentagon cross-section. The jet entangling process is in accordance with disclosures of the patents cited in Table 1.

Steam treatment device G consists of inlet 28 having a passage 30 eight inches (20.3 cm.) long and 0.070 inch (0.178 cm.) inside diameter, chamber 32 1.00 inch (2.54 cm.) long of 0.062 inch (0.157 cm.) inside diameter and orifice 34 of 0.046 inch (0.117 cm.) diameter, and outlet 38 having a passage 36 twelve inches (30.5 cm.) long and 0.070 inch (0.178 cm.) inside diameter.

Steam treatment device H is similar to G except that the inside diameter of passage 30 and passage 36 are 0.052 inch (0.132 cm.). Steam temperature in pipe 20 is measured by a thermocouple inserted into pipe 20 approximately 3 inches (7.6 cm.) upstream of orifice 34. Steam temperature in chamber 32 is measured by a thermocouple inserted in the wall of chamber 32 of device G flush with the inside bore of the chamber and opposite to orifice 34.

Properties of the yarns are shown in Table 1. Item 2 which is not steam treated, shows low bending rigidity ratio characteristic of untreated yarns and no filament skin modification. Items 5, 6, 10 and 11 although steam treated, are below acceptable levels of properties.

Item 12 has filament fusing within the limits of acceptability while Item 13 is more heavily fused and many of the filaments cannot be separated. Items 10 through 13 are nylon 6 which has a lower melting point than nylon 66.

The time during which the yarn is exposed to the steam is considered to be the total time which the yarn spends within steam treatment device 18 of FIG. 1. This is determined by dividing the overall length of the device from inlet 28 to outlet 38 by the yarn velocity.

During the test no substantial amount of stream was observed escaping from the inlet.

EXAMPLE 2

The yarns of Items 6 through 9 of Example 1 are tufted into carpet at ⅛ inch (3.18 mm) gauge and are tufted at a 5/16 (8 mm) inch cut-pile height, 32 oz/yd.$^2$ (1.086 kg/m$^2$) and are dyed under the same conditions. Item 6 shows some tuft distinction. Item 9 has tufts where the filaments appear cohesive with little intermingling of filaments with adjacent tufts, yet the carpet is soft and springy without harshness. Items 7 and 8 are intermediate in tuft distinction.

EXAMPLE 3

Three ends of cationic dyeable feed Yarn A are entangled and steam treated at the conditions listed in Table 2. Feed yarn A is a copolymer of nylon 66 and the sodium salt of sulfoisophthalic acid at about 2.2% by weight having a lower melting point than yarns B and C, and therefore the filaments can be expected to bond to a greater degree at similar conditions than Items 1, 2, 4 or 5–9 of Table 1. The yarns were treated at a series of temperatures to demonstrate products ranging from insufficiently to excessively bonded. This is a more extensive testing than Item 3.

It can be seen from the data in Table 2 that items 14–16 have bending rigidity ratios below about 20 and have skin thickness and Skin Deorientation Index too low to measure accurately.

TABLE 1

| Items | Yarn Components | Jet Entangling Process Used | Velocity (mpm) | Time (Sec.) | Steam Treatment Device 18 | Steam Temp. °C. Pipe 20 | Steam Temp. °C. Chamber 32 |
|---|---|---|---|---|---|---|---|
| 1 | 1 (A) | | 896 | 0.0357 | G | 173 | 160 |
| | 1 (B) | U.S. 4,059,873 | | | | | |
| 2 | 1 (C) | " | 896 | | G | No steam | No steam |
| 3 | 3 (A) | | 905 | 0.0354 | G | 173 | 152 |
| 4 | 3 (C) | " | 905 | 0.0354 | G | 173 | 152 |
| 5 | 3 (B) | Br. 2,085,040B | 946 | 0.0338 | G | 165 | 145 |
| 6 | " | " | 946 | 0.0338 | G | 167 | 147 |
| 7 | " | " | 946 | 0.0338 | G | 174 | 153 |
| 8 | " | " | 946 | 0.0338 | G | 179 | 159 |
| 9 | " | " | 946 | 0.0338 | G | 185 | 166 |
| 10 | 2 (D) | None* | 366 | 0.0875 | H | 130 | — |
| 11 | " | " | 366 | 0.0875 | H | 140 | — |
| 12 | " | " | 366 | 0.0875 | H | 150 | — |
| 13 | " | " | 366 | 0.0875 | H | 160 | — |

| Items | Denier | Mean Pull Apart (inch) | Mean Pull Apart (cm) | Bending Rigidity Ratio | Skin Thickness (micrometers) | Skin Deorientation Index |
|---|---|---|---|---|---|---|
| 1 | 4020 | 0.331 | 0.841 | 39.1 | 1.1 | 0.22 |
| 2 | 3980 | 0.646 | 1.641 | 6.3 | None | None |
| 3 | 3930 | 0.500 | 1.270 | 50.0 | 0.9 | 0.20 |
| 4 | 3990 | 0.603 | 1.532 | 39.6 | 1.1 | 0.17 |
| 5 | 3710 | 1.437 | 3.649 | 5.9 | 0.6 | 0.07 |
| 6 | 3720 | 1.650 | 4.191 | 15.4 | 0.9 | 0.14 |
| 7 | 3720 | 1.377 | 3.498 | 25.1 | 1.2 | 0.27 |
| 8 | 3730 | 0.758 | 1.926 | 84.5 | 1.1 | 0.26 |
| 9 | 3740 | 0.949 | 2.410 | 66.5 | 1.4 | 0.39 |
| 10 | 3860 | 1.203 | 3.056 | 4.0 | None | None |
| 11 | 3840 | 0.885 | 2.248 | 5.7 | 0.9 | 0.17 |
| 12 | 3890 | 0.486 | 1.234 | 128 | 2.7 | 0.67 |

TABLE 1-continued

| | | | | | | |
|---|---|---|---|---|---|---|
| 13 | 3800 | 0.183 | 0.465 | 202 | ** | ** |

*2 ply of D yarn twisted together
**Filaments fused together

TABLE 2

| Items | Yarn Components | Jet Entangling Process Used | Velocity (mpm) | Time (Sec.) | Steam Treatment Device 18 | Steam Temp. °C. Pipe 20 | Steam Temp. °C. Chamber 32 |
|---|---|---|---|---|---|---|---|
| 14 | 3 (A) | U.S. 4,059,873 | 905 | 0.0354 | G | No Steam | No Steam |
| 15 | " | " | " | " | " | 155.2 | 131.5 |
| 16 | " | " | " | " | " | 157.9 | 136.0 |
| 17 | " | " | " | " | " | 161.1 | 138.2 |
| 18 | " | " | " | " | " | 164.1 | 143.5 |
| 19 | " | " | " | " | " | 167.2 | 145.8 |
| 20 | " | " | " | " | " | 169.9 | 149.2 |
| 21 | " | " | " | " | " | 173.0 | 153.4 |
| 22 | " | " | " | " | " | 175.9 | 156.3 |
| 23 | " | " | " | " | " | 178.9 | 160.1 |
| 24 | " | " | 914 | 0.0350 | " | 181.8 | 164.4 |

| Items | Denier | Mean Pull Apart (inch) | Mean Pull Apart (cm) | Bending Rigidity Ratio | Skin Thickness (micrometers) | Skin Deorientation Index |
|---|---|---|---|---|---|---|
| 14 | 3747.8 | 1.360 | 3.454 | 9.5 | — | — |
| 15 | 3875.3 | 0.875 | 2.223 | 17.0 | — | — |
| 16 | 3814.0 | 0.675 | 1.715 | 17.1 | — | — |
| 17 | 3840.0 | 0.597 | 1.516 | 22.4 | 1.0 | 0.13 |
| 18 | 3842.7 | 0.609 | 1.547 | 29.1 | .9 | 0.15 |
| 19 | 3899.9 | 0.668 | 1.697 | 46.4 | 1.0 | 0.24 |
| 20 | 3877.7 | 0.413 | 1.049 | 136.8 | 1.0 | 0.24 |
| 21 | 3856.8 | 0.463 | 1.176 | 74.7 | 1.0 | 0.27 |
| 22 | 3917.9 | 0.415 | 1.053 | 180.3 | 1.0 | 0.27 |
| 23 | 3905.5 | 0.387 | 0.983 | 265.6 | 1.1 | 0.32 |
| 24 | 3897.2 | 0.293 | 0.744 | 309.8 | 1.4 | 0.56 |

EXAMPLE 4

The yarns of items 14 through 24 are tufted into carpet at ⅛ (3.18 mm) inch gauge and 5/16 (8 mm) inch cut pile height, 32 oz/yd$^2$ (1.086 kg/ m$^2$) and are dyed under the same conditions. Items 14–16 have little cohesion within the tufts, the filaments of each tuft spreading and intermingling with neighboring tufts to give a uniform matted appearance. Items 17–22 have tufts where the yarns appear cohesive with little intermingling of filaments with adjacent tufts, yet the carpet is soft and springy without harshness. Items 23 and 24 are harsh and excessively fused.

EXAMPLE 5

This example demonstrates that the filaments are lightly bonded together. The yarn was closely examined as described below.

To avoid disturbing the yarn's structures, yarns are embedded in an epoxy matrix before cross-sectioning. To do this, the specimen yarn is placed in a mold. Epoxy is poured around it and cured. The cured specimen block is removed from the mold, shaped and sectioned in a microtome. Cross-sections, mounted on a microscope slide, are photographed at suitable magnification.

The coated mold is sprayed lightly with release agent, and each cavity is lined with cellophane tape. Small "pillows" of double-faced masking tape (approximately 6 folds) are placed at the ends of each cavity.

Before placing the yarn in the molds, the yarn is prepared as follows. Approximately 200 mm of yarn are taped at both ends using small pieces of masking tape, clamps are attached to both ends, and the yarn is hung on a rack hook. Sufficient weight is added to the lower clamp to pull out any crimp, being careful not to stretch the yarn. Using an eyedropper, clear acrylic lacquer is applied a few drops at a time down the yarn. Approximately 10 applications about 3 minutes apart are made, then the sample is allowed to dry about 2 hours.

The coated specimen is placed in the mold cavity on the "pillows" of tape such that it lies below the mold surface but does not touch the bottom. The excess yarn is then cut off.

Epoxy resin to fill ~8 mold cavities is prepared by mixing the following:

Marglas Resin 658, crystal-clear epoxy casting resin (manufactured by Acme Chemicals & Insulation Co.): 21.7 g Marglas Resin 659, crystal-clear epoxy casting resin (manufactured by Acme Chemicals & Insulation Co.): 4.4 g Maraset modified diamine curing agent Hardener 558 (manufactured by Acme Chemicals & Insulation Co.): 25.0 g The resin mixture is stirred slowly for about 5 minutes to prevent bubble formation. Stirring should continue until the solution is clear.

The epoxy solution is then poured over each specimen. Bubbles can be eliminated by manipulation of the specimen with a pair of forceps. If the sample sinks to the bottom or floats to the top of the mold, the yarn must be repositioned. The resin can be cured at room temperature for 16 hours (or at 65° C. for 3 hours).

After curing, the room temperature cured mold is placed on a warming table for about 15 minutes. By grasping the ends of the cellophane tape, the warm specimen block can be removed from the mold. (Oven-cured specimens are removed from the mold immediately after removal from the oven.) The specimen block is cooled on a flat surface and then the cellophane tape is removed.

Each specimen block is shaped and then placed on a warming table for about 2 minutes to relax filaments. The specimen block is then mounted in a Microtome (Rotary Model 820—American Optical) and 7-micron thick cuts are made. The first few cuts are discarded. A good cut (one with no obvious air bubbles or knife blade marks or tilt to the filaments) is laid on a microscope slide thinly coated with Primol 335 (n=1.5) or mineral oil (n=1.47). Once the cut has been inspected under the microscope and determined to be satisfactory, a cover glass is placed over the specimen. Photographs are taken at appropriate magnification.

After carpet processing (but before latexing) yarn from carpet tufts is cross-sectioned as described by the above procedure with one exception. Because the yarn length is so short (approximately 15 mm), it is not suspended and dropped with clear acrylic lacquer. It is simply positioned in the center of the mold using the "pillows" of tape to keep it from touching the top or the bottom of the mold.

Figure 8:
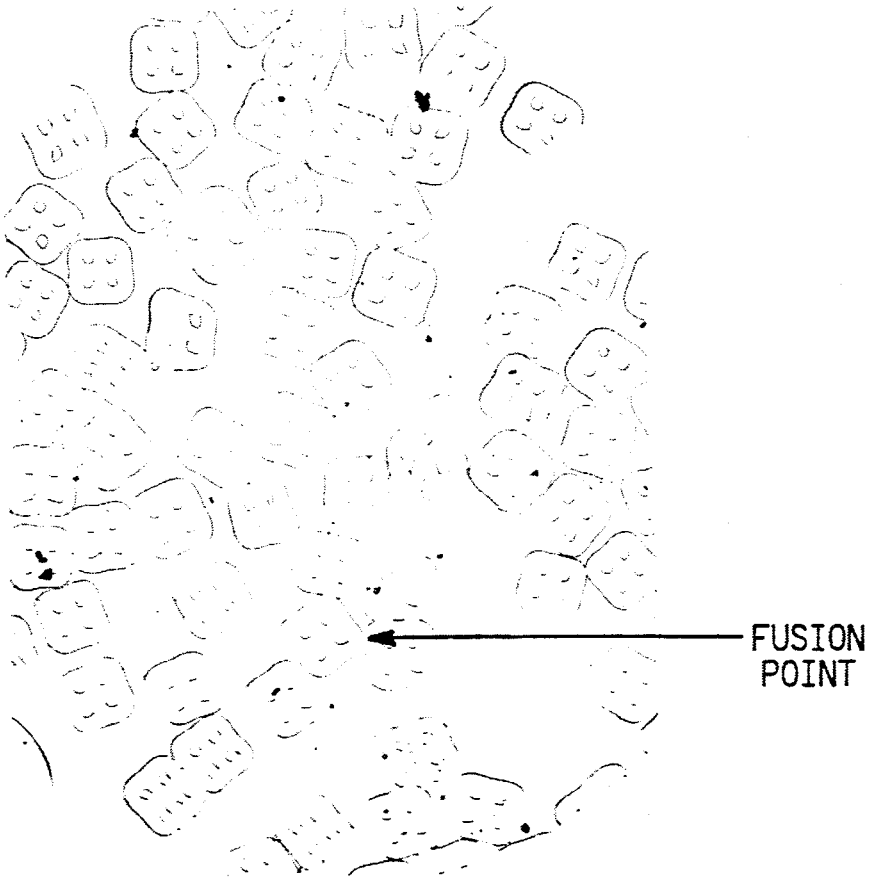
FIG. 8 is a photograph of a cross-section of the yarn of this invention.

Cross-sectional photographs of the yarns before and after carpet processing indicate increasing fusion points with increasing steam temperature and the loss of fusion points after carpet processing. Fusion is determined by examining the cross-sectional photograph for loss of boundary definition between two touching filaments. This is shown if FIG. 8 which is a cross-sectional photograph of Item 21 before processing. Item 21 retains some fusion points after carpet processing and an increasing amount of fusion points are retained as steam temperature is increased between Items 22 and 24.

EXAMPLE 6

This example shows that above the temperature at which the light bonds are first formed the amount and the strength of the bonds increases as the steam temperature increases.

A length of yarn is held down on a block made from Teflon® tetrafluoroethylene resin. A razor blade is held on the block at a 30° angle and drawn across the yarn twice to cut a yarn segment approximately 5 mm long. Care is taken not to disturb interfilament bonds which may be present in the segment of yarn which is cut. The sample segment should be cut from an area of the yarn which is of average visually apparent bundle cohesion. It should not be cut from a section of yarn which is splayed or tightly knotted, as in an "interlace node". A segment thus cut from a yarn having interfilament bonds will remain substantially intact.

The 5 mm yarn segment prepared as described above is placed in a 250 ml glass beaker containing 150 ml of water. A BRAUN-SONIC 7510 sonic probe manufactured by B. Braun Melsungen AG is emerged in the water and the sample is agitated at about 400 watts for 3 min. The degree of yarn segment bundle separation into individual filaments is then observed.

| Item | Observation |
|---|---|
| 5 | Following agitation yarn bundle completely broke up into individual filaments. |
| 6 | Following agitation yarn bundle completely broke up into individual filaments. |
| 7 | Following agitation yarn bundle broke into two large pieces, approximately 6 clumps of filaments, and approximately 12–24 individual filaments. |
| 8 | Bundle remained intact, except for approximately 15 filaments that separated. |
| 9 | Bundle remained intact, except for approximately 5 filaments that separated. |

What is claimed is:

1. A substantially twist-free multifilament polyamide combined yarn suitable for use in cut-pile applications, comprising a plurality of crimped filaments lightly bonded at points of contact, said filaments having an oriented core portion and a deoriented skin portion, said yarn being characterized by a bending rigidity ratio ($R/R_{cfm}$) of greater than about 20 and less than about 200, said filaments being characterized by a Skin Deorientation Index of greater than about 0.05.

2. The yarn of claim 1 characterized further by a thickness of the deoriented skin portion of the filaments of greater than about 0.4 micrometers and less than about 4.0 micrometers.

3. The yarn of claim 2 where the number of filaments is less than about 500 and the denier per filament is greater than about 5 and less than about 40.

4. The yarn of claim 1 wherein the Skin Deorientation Index is less than about 0.5.

5. The yarn of claim 2 wherein $R/R_{cfm}$ is greater than 20 and less than 75.

6. The yarn of claim 5 characterized further by a lateral pull-apart distance greater than about 0.25 cm. and less than about 10 cm.

7. The yarn of claim 6 wherein the thickness of the deoriented skin portion of the filaments is greater than 0.8 micrometers and less than 1.5 micrometers.

8. The yarn of claim 1 where the multifilmanet polyamide yarn has a twist of from about 0.33 to 2.0 twists per cm.

* * * * *